US005761744A

United States Patent [19]

Horvat et al.

[11] Patent Number: 5,761,744

[45] Date of Patent: Jun. 9, 1998

[54] SHIRT COLLAR HIDDEN SNAPS

[76] Inventors: John Horvat; Mary Ann Horvat, both of 2308 Beverly Way, Las Vegas, Nev. 89104

[21] Appl. No.: 194,904

[22] Filed: Feb. 14, 1994

[51] Int. Cl.[6] ..... A41D 27/18

[52] U.S. Cl. ..... 2/129; 2/131; 2/132; 2/134

[58] Field of Search ..... 2/60, 123, 124, 2/104, 105, 106, 115, 121, 122, 129, 131, 132, 133, 139, 140, 141.1, 130, 134, 135, 136, 137, 138, 141.2, 142, 143

[56] References Cited

U.S. PATENT DOCUMENTS

| | | | |
|---|---|---|---|
| 1,606,920 | 11/1926 | Bornstein | 2/139 |
| 2,774,075 | 12/1956 | Saccoccio | 2/106 |
| 3,860,967 | 1/1975 | Tedesco | 2/129 |
| 4,939,794 | 7/1990 | Aronson | 2/60 |

FOREIGN PATENT DOCUMENTS

| | | | |
|---|---|---|---|
| 1246941 | 10/1960 | France | 2/139 |
| 2043061 | 3/1972 | Germany | 2/140 |

*Primary Examiner*—Jeanette C. Chapman
*Attorney, Agent, or Firm*—William Ruano; David Volk; Brendan Dix

[57] ABSTRACT

A pair of concealed, vertically spaced snaps underneath each side of a shirt collar to cooperate with snap fasteners concealed on the shirt, to make the collar looked pressed and attractive at all times.

1 Claim, 2 Drawing Sheets

SHIRT COLLAR HIDDEN SNAPS

BACKGROUND OF THE INVENTION

In the past, attempts have been made to maintain the pressed condition of shirt collars by attachments, such as collar clips, sewed on buttons and the like, which have detracted from the natural appearance of shirt collars.

SUMMARY OF THE INVENTION

A pair of concealed, vertically spaced snaps underneath each side of the collar to overcome the above-named disadvantages of known types of attachments as well as to greatly reduce costs.

DESCRIPTION OF THE PREFERRED EMBODIMENTS

Figure 1:
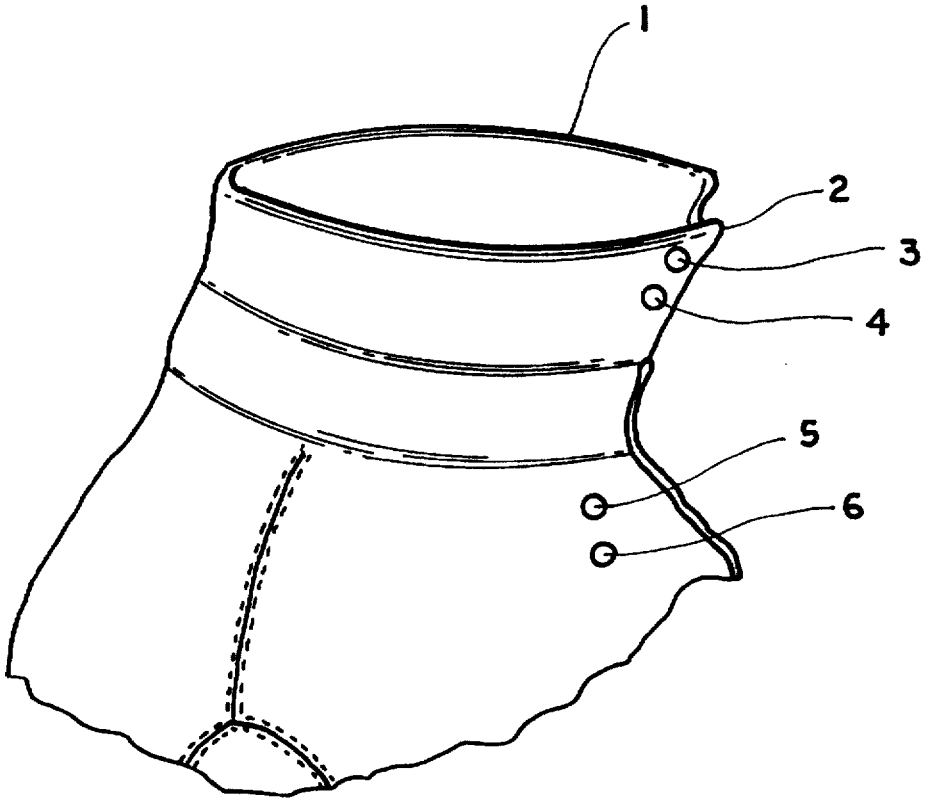
FIG. 1 is a front view of a collar with turned up, front end portions to show a pair of snaps on each of the front ends of the collar.
Figure 2:
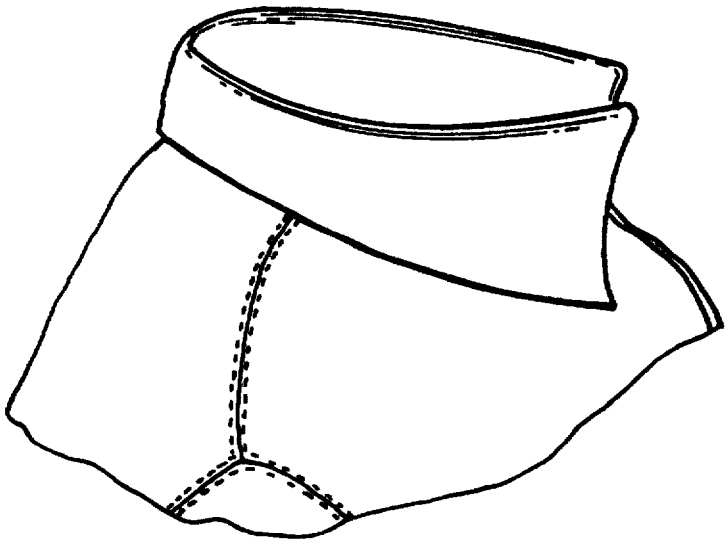
FIG. 2 shows the final appearance of the collar after the snaps are in place underneath the collar.

Referring to FIG. 1, numerals 1 and 2 denote the front ends of a collar and numerals 3 and 4 denote the rear snaps sewn underneath thereof which cooperate with snap fasteners 5 and 6.

The rear snaps 3 and 4 are preferably arrange with one on the bottom edge and the other about or a little more than half way up so as to hold the collar correctly and neat as collars should always be, and yet be unseen. Thus the front ends cannot be bulged up in the air as generally happens with uncontrolled front collar ends.

A modification, although less effective, is to use only one snap and fastener about half way up each collar front end.

Of course, the snaps and fasteners may be reversed in location, the fastener underneath the collar and the snap on the shirt.

Figure 3:
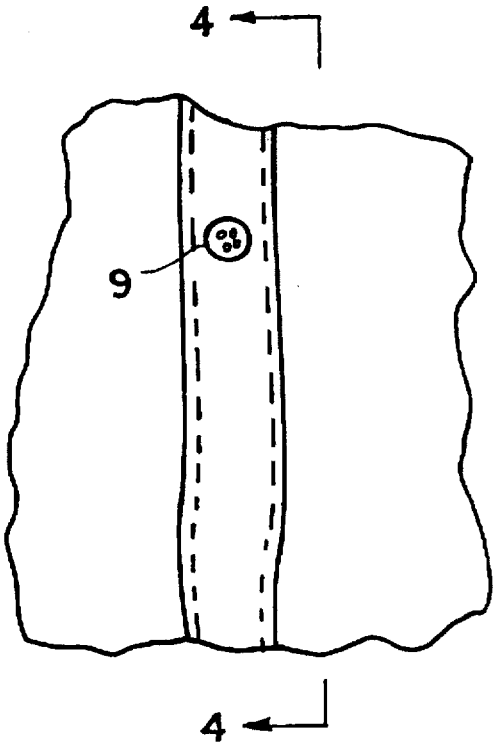
FIG. 3 is a fragmentary front view and FIG. 4 is a sectional view taken along line 4—4 of FIG. 3 of a modification of a shirt front.
Figure 4:
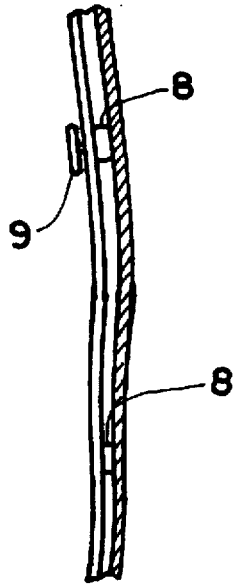

FIGS. 3 and 4 show a modification of the invention as applied to a shirt front. Numerals 8.8 denote snaps and numeral 9 denotes a fake button.

Figure 5:
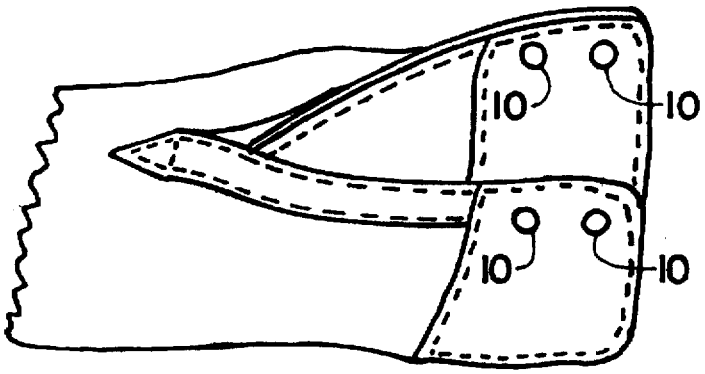
FIG. 5 is a perspective view of a modification applied to a shirt sleeve.

FIG. 5 shows another modification as applied to a shirt sleeve 10 wherein numerals 10 denote snaps.

We claim:

1. In combination with a shirt having a collar, a pair of concealed, disc shaped snaps underneath each collar end and a pair of corresponding, disc shaped fasteners on each side of the shirt portion underneath said collar end, one of each of said pair of concealed, disc shaped snaps being about half way up said collar and the other of said pair of corresponding, disc shaped snaps being on the edge of said collar, concealed in front of the shirt and being in snapping relationship to said disc shaped fasteners.

* * * * *